US005171498A

United States Patent [19]

Powell

[11] Patent Number: 5,171,498

[45] Date of Patent: Dec. 15, 1992

[54] MANUFACTURE OF BONDED PARTICLE BOARDS

[75] Inventor: William A. Powell, Gwent, United Kingdom

[73] Assignee: Pyrok Technology Limited, Hengoed, United Kingdom

[21] Appl. No.: 668,827

[22] Filed: Mar. 13, 1991

[30] Foreign Application Priority Data

Mar. 15, 1990 [GB] United Kingdom ..... 9005806

[51] Int. Cl.[5] ..... D04H 17/00; D04H 1/70

[52] U.S. Cl. ..... 264/113; 264/121; 425/81.1; 425/83.1

[58] Field of Search ..... 264/112, 113, 121; 425/81.1, 83.1

[56] References Cited

U.S. PATENT DOCUMENTS

| | | | |
|---|---|---|---|
| 2,744,045 | 5/1956 | Collins | 264/113 |
| 2,979,105 | 4/1961 | Burkner | 425/81.1 |
| 3,299,478 | 1/1967 | Gaitten | 425/81.1 |
| 3,873,662 | 3/1975 | Cartlidge et al. | 264/113 |
| 4,402,890 | 9/1983 | Offenhausen et al. | 264/37 |
| 4,483,668 | 11/1984 | Poppelreuter | 425/81.1 |
| 4,942,003 | 7/1990 | Bold | 264/40.4 |

FOREIGN PATENT DOCUMENTS

| | | | |
|---|---|---|---|
| 2136754 | 9/1984 | United Kingdom | 425/83.1 |
| 2136837 | 9/1984 | United Kingdom . | |

*Primary Examiner*—Mary Lynn Theisen

*Attorney, Agent, or Firm*—Spensley Horn Jubas & Lubitz

[57] ABSTRACT

A cement-bonded particle board with finer particles concentrated at the surfaces of the board and coarser particles concentrated within the board is formed by spreading the particulate material onto a moving carrier (50), the particulate material initially being projected in a first generally horizontal direction above the carrier and allowed to fall gravitationally without interacting with any fixed surface, whilst the falling particles are subjected to a through-flow of air [B] immediately above the carrier in a second direction opposite to that in which the particles are initially projected, the coarser particles being projected preferentially in said first direction and the finer particles being carried preferentially in said second direction by the airstream [B] to effect a second stage of separation.

23 Claims, 1 Drawing Sheet

MANUFACTURE OF BONDED PARTICLE BOARDS

BACKGROUND OF THE INVENTION

Figure 1:
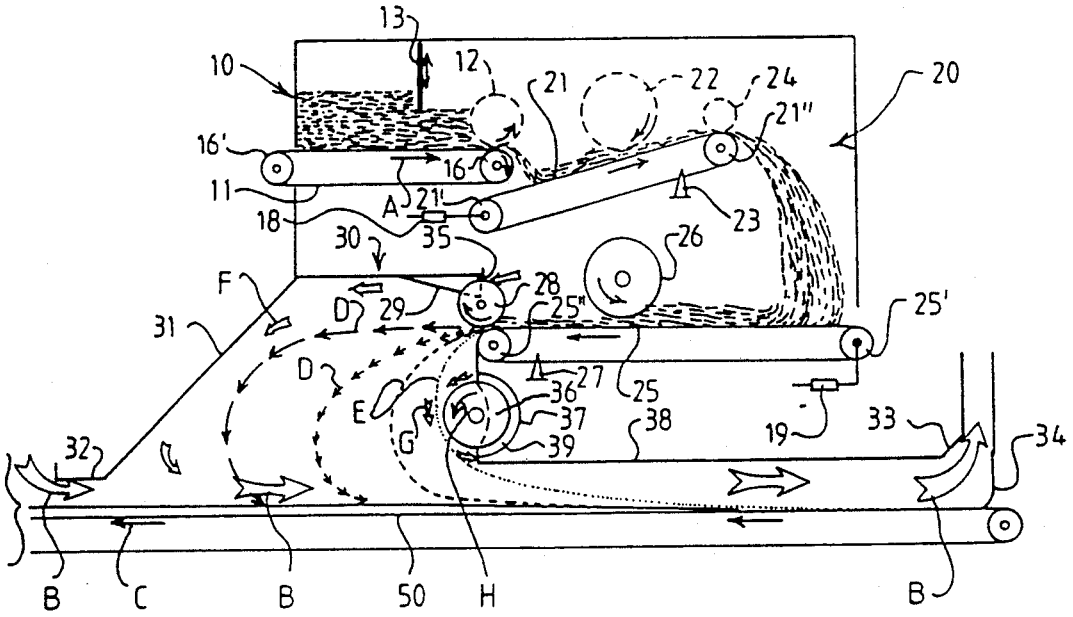

This invention relates to the manufacture of boards from materials which are mixtures of particles having a range of sizes, such particles being bonded together to form boards.

More particularly, the invention is concerned with the manufacture of boards composed of particles in the nature of wood bonded by cement. The wood particles used typically comprise a mixture of very fine particles in the nature of wood flour and coarser particles in the form of filaments, the dimensions of the particles in the mixture varying from less than 0.5 mm to more than 30 mm.

This material, with minor additives, is mixed with cement powder and water in such a manner as to cause the wood particles to become effectively "wetted" by the cement before they are laid down into a layer which is compressed and cured to form the finished board. The method by which the wood particles are wetted with cement is known and does not form part of this invention.

However, it is highly desirable to grade the cement-wetted particles in such a way that the finest particles form the surfaces of the finished board, with the coarser particles at the interior. Whilst this effect could be achieved by grading the wood particles before they are coated with cement, the increased complexity and size of the plant required to separate and handle different grades of wood particles, and the duplication of the cement coating process step for each grade of particle make this approach less attractive commercially and in terms of the properties of the board. For this reason, there have been attempts to devise a process for spreading the cement-wetted wood particles in such a manner that they are graded in the required manner as they are formed into a board.

As is known, the spreading of the bulk material consisting of coarse and fine particles, e.g. coarse and fine chips, for the manufacture of wood particle boards, particularly cement-bound wood particle boards, is one of the most important process steps in the industrial mass production of wood particle boards. The spreading of the bulk material onto a forming belt, which is situated in the spreading direction below the spreading device, serves to make the so-called preforms, i.e. a particle cake or particle mat, whose quality is decisive with regard to the final properties of the boards being manufactured. It is of particular importance in this connection that the preform is spread with maximum accuracy and uniformity, since only in this way is it possible for the required bulk material to be used in an economic manner. Further, the demand for accuracy and uniformity of the spreading operation is very significant from the technological point of view so that it is possible to manufacture boards of a predetermined, required quality in terms of structure and strength. Moreover, the uniform distribution of the bulk material over the cross-section of the board is of decisive importance with regard to the degree and uniformity of the strength properties of the finished cement-bonded wood particle board.

The known spreading methods can be divided into two categories in the fabrication of particle boards.

The first group comprises installations in which the bulk material is spread according to the so-called air separation method. In this system, the particle mat coming from the metering hopper reaches a delivery roller, for example a spiked roller, which scatters the particles, thereby causing a disintegration of the mat. The falling particles then fall through an air stream which distributes them onto the forming belt in such a way that the finest particles are deposited in the outer layers and the coarse particles in the middle layer. This process of air separation spreading works satisfactorily for particle boards, but exhibits a considerable disadvantage in the case of cement-bound wood particle boards. The known method only results in satisfactory spreading if the cement-wetted particles do not exceed a certain overall moisture content. Although such cement-wetted particles can still be satisfactorily spread, there result boards with relatively low strength values.

Attempts have already been undertaken to eliminate this disadvantage in the case of three-layer boards in that the dry covering layers are spread by air separation while the middle layer of the board is spread in a different manner so that the moisture in the middle layer can be kept higher. nevertheless, the results are not on a par with the boards in which all layers can be produced with sufficient moisture. In addition, the separate spreading of particles of differing moisture content for the covering layers and the middle layer is only economical in larger plants, especially as it also requires increased investment.

The second group comprises those installations which work with gravity spreading. In this method, the particles coming from the metering hopper are delivered to the rotating spreading device, for example rotating rollers, spiked rollers or similar, e.g. by means of a metering belt, whereby the spreading devices, such as rollers or similar, break up the bulk material on the metering belt and cast it in the direction of the moving forming belt which is underneath the spreading device. The motion of the individual particles results in a certain separating effect in that the heavier coarse particles assume longer trajectories and the lighter, fine particles assume shorter trajectories. The trajectory, as well as the degree to which the bulk material is broken up, are determined by the peripheral speed of the rollers which are provided with spikes or cams.

In many cases use is made of an entire system of such spreading rollers in order to obtain satisfactory breaking up and separation of the particles. Nevertheless, this method has numerous deficiencies, such as uneven separation, short spreading angles, reduction in weight at the edges of the board, build-up at the walls etc. The most disadvantageous effect is that very often individual coarse chips get into the covering layer consisting of finer chips, with the result that the uniform structure of the find covering layers is destroyed. A further disadvantage of the known gravity spreading methods is that the rotation of the spreading devices results in uncontrollable air streams which entrain in particular the fine and superfine particles so that there is inaccuracy of spreading. The uncontrolled air streams also result in undefinable flow conditions in the spreading space above the forming belt. All these disadvantages have an even greater impact when spreading cement-bound wood particle boards.

One particular process as described in British Patent Specification No. 2136837 involves allowing the cement-wetted wood particles to fall onto a travelling belt whilst subjecting the material to a forced air-flow in order to effect at least partial separation of different particle sizes whereby the finer particles are drawn downwardly by such air-flow and brought to the belt by a shorter route than the coarser particles, which are themselves projected forwardly and deflected downwardly off a baffle so as to follow a longer route than the finer particles and settle on top of the finer particles deposited on the belt by the shorter route.

In our experience, this process is capable of improvement and it is an object of the invention to provide an improved method and apparatus for forming bonded particle boards. More particularly the object of the invention is to create a method of spreading bulk material containing lignocellulose and consisting of coarse and find particles, particularly cement-wetted particles, said method avoiding the aforementioned disadvantages and in which the fine and coarse particles are separated uniformly and with a fine transition from which other over a large area so that the occurrence of internal stresses during pressing is largely reduced and the stability of the boards and their strength characteristics are enhanced. The object of the invention also includes the creation of a device enabling the method according to the invention to be implemented.

Accordingly the first aspect of the invention resides in a method of spreading a particulate material comprising particles having a range of dimensions to form a layer in which the particles are graded according to their dimensions, comprising the step of initially projecting the particulate material in a first generally horizontal direction and allowing the material to fall gravitationally onto the moving carrier whilst subjecting the material a controlled air-flow, characterised by the steps of allowing substantially all of the particles to fall onto the carrier without interacting with any fixed surface and subjecting the falling particles to a through-flow of air immediately above the carrier in a second direction opposite to that in which the particles are initially projected.

We have found, particularly with particles of wood of the kind produced by flaking timber into flakes of 0.35 mm thickness and 30 mm width and then subjecting such flakes to a hammer-milling operation to produce a mixture of wood particles ranging from wood flour, comprising particles of less than 0.5 mm, to filaments of about 30 mm in length, that the finer particles firstly are projected less efficiently in the first direction than the coarser particles so as to effect a first step partial separation and secondly are swept along by the air-flow in the second direction above the belt to a greater extent than the coarser particles to effect an enhanced separation, which is a significant improvement on the prior proposal outlined above.

Preferably the method includes the further step of subjecting the protected particles to a secondary air-flow in the direction of projection at a position adjacent to the point at which the material is projected and before the particles are subjected to said air-flow immediately above the carrier and also the further step of subjecting the falling particles at a position beneath the point at which the material is projected to a circulating air-flow to assist downward movement of the falling particles so subjected.

If the moving carrier is travelling in the first direction, the result is that as the finest particles are carried by the air-flow in the opposite direction they are deposited on the carrier at a position in advance (relative to the direction of carrier travel) of the position at which the material is projected in the first direction, so as to form a layer of very fine particles directly on the carrier. Successively coarser particles are deposited further along the belt to build up a layer with the coarsest particles on top.

This layer may be employed without further addition for the manufacture of particle board having a smooth surface on one face only, but normally, in a second stage, further material will be added by projecting it at a second spreading station in the opposite direction, i.e. contrary to the direction of travel of the carrier, and subjecting it to an air-flow in this case in the same direction as the travel of the carrier. In this way, the coarsest particles are deposited first onto the existing layer on the carrier and the finest particles form an upper, facing layer. In either case, the deposited layer is then compressed and cured as necessary to enable the particles to bond together.

The velocity of the air-flow immediately above the carrier may be so controlled as to produce a layer of deposited material which is of controlled, i.e. uniform, concave or convex, thickness in a direction transverse to the direction of movement of the carrier.

Preferably the particulate material is delivered at a metered rate to the point at which it is projected, said material being carried by a feed belt at the base of a bin in which said material is stored to a discharge roller whereby the material is discharged from the bin to means for weighing and volumetrically metering said material and feeding it to the point at which it is projected, wherein the depth of material fed to said discharge roller is controlled by a vertically arranged vibrating plate spaced above said feed belt so as to hold back the bulk of the material in the bin and allow a layer of controlled depth to be carried by the feed belt towards the discharge roller.

A second aspect of the invention resides in apparatus for spreading a particulate material comprising particles having a range of dimensions to form a layer in which the particles are graded according to their dimensions, comprising means for moving a carrier in a generally horizontal direction, a hood arranged over the path of the carrier and defining a main air inlet and a main air outlet at spaced positions immediately above the path of the carrier, means for projecting said material into said hood in a first generally horizontal direction at a position spaced above the path of the carrier, the hood being so shaped and dimensioned as to allow substantially all of the particles to fall gravitationally onto the carrier without interacting with any fixed surface, and means for causing air to flow through the hood from said main air inlet and immediately above the path of the carrier to said main air outlet so as to establish a main air-flow through the hood in a second direction opposite to that at which the material is initially projected.

The apparatus may further comprise a delivery belt for said particulate material which terminates at a material inlet formed in the hood at a position above and between the main air inlet and main air outlet.

The means for projecting the material may comprise an input roller which affords a plurality of radially extending elements which engage the material on the delivery belt, the input roller rotating in such a direction and at such a speed as to project the material into the interior of the hood in said first direction.

The roller preferably comprises a plurality of axially spaced toothed discs.

The larger, generally filamentous particles tend to be engaged by the individual teeth of such a roller and effectively projected in the required direction by virtue of rotation of the roller, whereas the finer particles, more in the nature of wood-flour, tend to flow between the individual strands, with the result that they acquire less horizontal velocity. Thus, the coarser particles are thrown forward relative to the finer particles.

In accordance with a further feature of the invention, the roller is provided with inserts of a hard material, such as tungsten carbide, at the tip of each tooth. This has been found to give rise to a great increase in the working life of such a roller thereby consistently projecting the material over longer periods of operation.

A forced-air circulation within the hood may be employed to draw the finer particles downwards more positively. For this purpose, a toothed roller may be disposed immediately below the material inlet, the roller being rotated in such a direction as to induce a downward air flow in the region forwardly of the end of the delivery belt relative to the direction in which the particles are projected. This enhances the separation of the fine and coarse particles. Preferably such toothed roller comprises a plurality of axially spaced toothed discs.

Moreover, to reduce an observed tendency for such a roller to impose a component of axial flow on the particles, a further feature of the invention resides in the provision of baffle plates between individual discs at spaced positions along the axis of the input roller. This offsets an observed tendency for the material to drift towards one edge of the moving belt under the influence of such a roller thereby, if unchecked, resulting in the deposited material being of greater thickness at one edge of the finished board than at the other.

Whilst, in the prior proposal mentioned above, there is an air inlet between such toothed roller and the underside of the delivery conveyor, we have found, in accordance with a preferred feature of the invention, that it is preferable to close off the space between the toothed roller and the delivery conveyor, and instead to provide an auxiliary air inlet only at a position above the input roller above the delivery conveyor which projects the particles in said first direction.

In this way, in addition to the main air-flow between the main air inlet and the main air outlet immediately above the moving belt on which the material is deposited, there is a secondary air flow which assists the forward projection of the coarser particles, and a circulating air-flow which assists the downward movement of the finer particles towards the main air-flow.

A further feature of the present invention concerns the metering of the particulate material before it reaches the spreading station.

This feature of the invention relates to a method of metering thin, small-piece bulk material containing lignocellulose, such as wood, bagasse or similar chips, wood fibres etc., particularly for the manufacture of cement-bound wood particle boards, in which the bulk material is discharged from a bin and then volumetrically metered on a circulating belt and brought through a spreading device, such as a spreading roller, onto a forming belt, having a bin for the bulk material which is provided with binding agent, particularly cement, with at least one discharge device, such as discharge rollers, discharge belt or similar, and a downstream metering belt on which is disposed at least one volumetric metering device, for example a skimming roller, which influences the weight and/or the volume of the bulk material, said metering device being followed at the end of the metering belt by a spreading device, such as a spreading roller or similar.

In both the manufacture of hardboards, such as particle boards, particularly cement-bound particle boards, the conventional procedure has been that the particles stored in a bin, such as hopper or silo, and provided with binding agent, or particles mixed with cement in the case of cement-bound particle boards, are brought by a discharge device, for example a discharge roller co-operating with a discharge belt, onto a downstream conveyor belt. The discharged quanity of bulk material is metered by weight either cycle-by-cyle on the entire belt of a belt section or volume metered, and is then spread by a spreading device, for example by air separation or by a gravity spreading device, onto the forming belt which accepts the preform which is subsequently to be pressed. With regard to the quality of the finished boards it is very important that the forms, cakes or mats which are spread onto the forming belt are uniform in terms of height, density and structure (interweaving, felting, interlacing etc) so that the finished board has a structure which is as uniform as possible over its entire cross-section. Therefore, it is important that the particles which are wetted with binding agents, particularly cement, be distributed during manufacture as uniformly as possible on the forming belt in width and length.

The particle board industry employs two known methods, namely the so-called volumetric metering of the bulk material or its metering by weight. It is also known to combine volumetric metering and metering by weight.

For volumetric metering, use is made usually of so-called metering rollers, also called skimming rollers, which are height adjustable in relation to the conveyor belt transporting the bulk material. Depending on the height of such a metering roller in relation to the conveyor belt or metering belt transporting the bulk material below, there results a variable cross-section, a so-called metering slit, through which the bulk material can pass in uniform weight, i.e. volumetrically metered. The speed of the conveyor belt conveying the bulk material and the height of the metering slit for the bulk material, i.e. the height of the metering or skimming roller, result in the volumetric quantity of bulk material which is spread onto the actual forming belt for the formation of the preform, cake or mat.

A considerable disadvantage of this method is that the bulk material accumulates in front of the metering roller which, as already mentioned, is usually in the form of a skimming roller, as a result of which there is a separation, demixing or build-up of the bulk material such that the bottom-most layers of the bulk material on the forming belt exhibit a much higher bulk weight than the upper layers as a result of the fines and superfines which accumulate there and/or as a result of pile-up. This changes the uniform composition and thus the mass-related quantity of bulk material, which considerably affects the uniformity and accuracy of the spread preform and thus the desired uniform composition of the finished board and, consequently, its strength characteristics.

This disadvantage is even more pronounced in the case of cement-bound boards than in the case of particle boards provided with binding agents, such as glue, because in the case of cement-bound boards as a result of the cement component the bulk weights are 1½ to 2½ times as great as in the case of particle boards bound with glue. Accordingly, as a result of the greater weight, i.e. the greater mass of the bulk material with cement, the above-described disadvantage is even more pronounced in the case of falling and throwing with the result that there are even greater deviations of the mass per unit of volume.

In the known methods, metering by weight is carried out either continuously, for example by means of a conveyor-type weigher, or intermittently, e.g. by means of a cyclic weigher. In practice, the continuous systems employing a conveyor-type weigher or radioactive weight monitoring are gaining ground. In systems with a conveyor-type weigher the quantity of bulk material per unit of time is precisely determined, but the uniform discharge of the bulk material and its distribution on the forming belt are in no way guaranteed. One of the causes of this is that in the systems with a conveyor-type weigher the bulk material is usually brought onto the conveyor-type weigher by way of volumetric metering with a vibrating conveyor. Since, however, the conveyor-type weigher has a limited length and reacts to the total weight of the bulk material, it cannot cope with the fluctuations in time and/or space of the weight of the bulk material.

The distance in time and space between the pulse generator, i.e. the conveyor-type weigher, and the actuator influenced by this conveyor-type weigher, i.e. the metering roller (skimming roller) results in inevitable non-uniformity and inaccuracy in the flow of bulk material. These irregularities are incorporated directly into the spread preform and thus into the finished board.

The problems are similar withe the known systems which employ radioactive isotopes for measuring the weight of the bulk material. As pulse generators, these measuring devices control either a metering roller (skimming roller), as is known from volumetric metering, or a height-adjustable skimmer, scraper or similar actuator which can be viewed as having the same effect as a metering roller with regard to its operating principle. In both cases, there is a build-up of the bulk material in front of such an actuator with the consequent disadvantages already described in the discussion of volumetric metering.

It has been shown that in both above-described known metering methods the variations of spreading, expressed by the area density, are more than ±6% in one and the same board and more than ±4% from board-to-board. Such great variations in the raw density in one and the same board and from board-to-board result in considerable disadvantages, firstly in the manufacture of the board, particularly during the actual pressing operation, during the swelling of the board and afterwards during the processing of the boards, for example, during smoothing, cutting, milling etc.

In accordance with a proposal as described in British Specification No. 2136754 bulk material is discharged from a bin and subjected to two successive weighing and volumetric metering steps before application to a spreading station. In this proposal, the initial dispensing of the bulk material from the bin is controlled by a belt conveyor which forms the base of the bin, a discharge roller above the discharge end of the belt conveyor which rotates in such a direction as to assist discharge of the bulk material, and a further roller which rotates in the opposite direction to skim excess material away from the discharge roller and return it to the interior of the bin.

We have found it is preferable to control the depth of material which is fed on the belt to the discharge roller by means of a vertically arranged vibrating plate spaced above the belt at the base of the bin, so as to hold back the bulk of the material in the bin and allow a layer of controlled depth to be carried by the belt towards the discharge roller.

The method and apparatus according to the invention make it possible for particle boards, particularly cement-bound particle board, to be metered with optimum uniformity at the factory with regard to the ready-mixed bulk material such that in its width and in its length, i.e. over the entire cross-section of the board, the bulk material is present in uniform height, density, distribution and structure. In particular, this eliminates the previously accepted demixing and accumulation of the material as a result of volumetric metering and the consequent (particularly in the case of cement-bound wood particle boards) variations of spreading and thus the variations with regard to the strength values of the finished board, particularly the bending and transverse tensile strengths.

Figure 2:
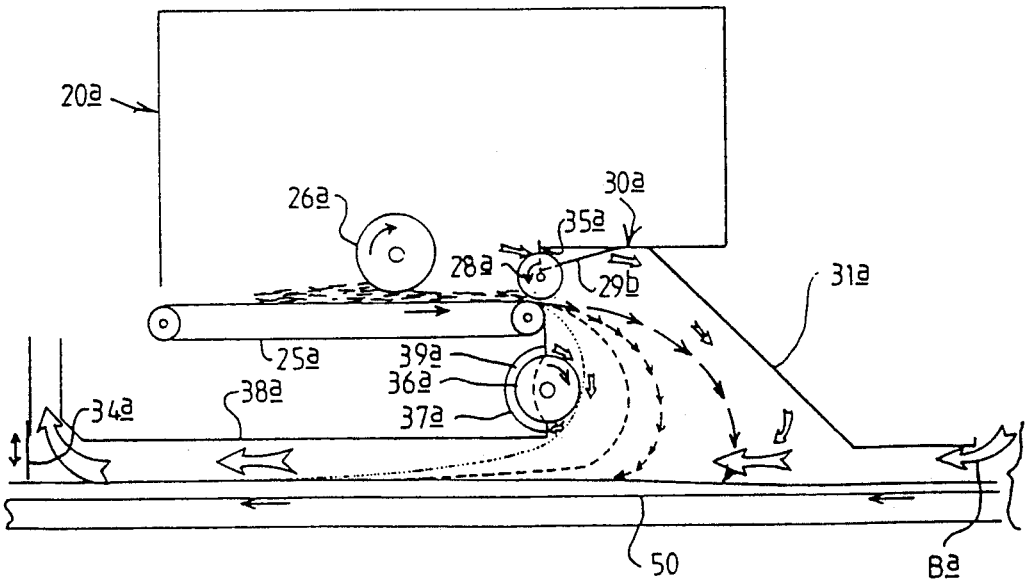

These and other features of the present invention will now be described by way of example with reference to one specific embodiment as illustrated in the accompanying drawings wherein:

FIG. 1 shows, in diagrammatic form, one spreading station in an installation for manufacturing particle board in accordance with the invention; and FIG. 2 similarly shows a second spreading station.

In the spreading stations bulk material consisting of cement-wetted wood particles as previously described is supplied from storage hoppers 10, through metering apparatus 20, 20*a* to spreading heads 30, 30*a* which are arranged at spaced positions along a travelling belt 50 which supports a series of steel carrier plates (not shown for simplicity).

By way of illustration, the material supplied to the hoppers 10, comprises particles of wood in the form of a mixture ranging from very fine particles in the nature of wood flour, with particles sizes ranges down to less than 0.5 mm, and wood filaments of a length up to more than 30 mm, such wood particles being treated in known manner with cement and water so as to be effectively wetted by the cement.

In the lower region of the hopper 10 there is a discharge belt 11 which moves in the direction of arrow A and is driven by the roller 16 and also runs over roller 16'. In the front region of this discharge belt 11 there is a discharge roller 12 which co-operates with the later and rotates in the direction of the arrow. One wall of the hopper 10 is formed by a vibrating vertical plate 13 which by virtue of its vibration assists the flow of the material towards the discharge roller 12 and at the same time controls the depth of material supplied by the belt conveyor 11 to the discharge roller 12.

The bulk material discharged from the hopper 10 by means of the discharge roller 12 passes onto a conveyor belt 21 which is termed the premetering belt. The premetering belt 21 is driven by a drive roller 21'' and also runs over a positionally movable idler roller 21'. In front of the drive roller 21'' there is a volumetric metering device in the form of a skimming roller 22 rotating in the direction of the arrow. It can be seen that the bulk material accumulates somewhat in the region before the skimming roller 22 due to the premetering belt 21 running in the direction of the arrow. To prevent an extreme accumulation of the bulk material in this region, which would cause the demixing of the bulk material as is the case in customary devices, the premetering belt 21 is fixed by means of a support 23, preferably between the skimming roller 22 and the front drive roller 21''. The support is shown in diagrammatic form and may be a transverse shaft (not shown in greater detail) which is supported in a fixed manner on either side of the metering belt 21. The premetering belt 21, which is thus supported in its front region is connected in the region of the idler roller 21', to a load cell 18 which measures the weight of the bulk material on the belt 21. Due to the offcentre mounting of the belt 21 on support 23, and the distant location of the load cell 18 the inflowing quantity of material is measured faster and more accurately, and the sensitivity of the weighing device is considerably enhanced.

In the front region of the premetering belt 21 there is, in known manner, a spreading device, e.g. a spreading roller 24, for the bulk material coming into the area of this spreading device, said bulk material having been premetered by volume and by weight on the premetering belt by the above described arrangement. Instead of a spreading roller 24 it is also possible to provide other spreading means which are suitable for spreading the bulk material.

The load cell 18 is connected control-wise to the drive for the discharge device, particularly to the discharge belt 11 of the hopper 10. Due to this arrangement of the premetering belt 21 through the provision of a weighing means, for example the load cell 18 on this premetering belt 21, the bulk material on the premetering belt 21 is measured by weight and the measured weight values are transmitted via the measuring device, i.e. load cell 18, directly to the drive of the discharge belt 11 so that there is a constant weight of bulk material per unit of time on the premetering belt 21.

Furthermore, this bulk material is volumetrically metered once again by means of the skimming roller 22 and is thus smoothed, as a result of which control-related fluctuations in the weight of the bulk material are largely prevented.

The bulk material, whose weight is thus kept even per unit time on the premetering belt 21, comes, after it has been smoothed by the skimming roller 22, into the area of the spreading device in the form of the spreading roller 24. As a result of this the bulk material is once again finely distributed and spread onto the fine metering belt 25 which is downstream of the premetering belt 21. This fine metering belt 25, which circulates in the direction indicated by the arrow, is driven by a front drive roller 25'' and also runs over the positionally movable idler roller 25', is likewise equipped in its front region with a skimming roller 26. The latter, just like the skimming roller 22 of the premetering belt 21, may be height-adjustable. Furthermore, in the region between skimming roller 26 and front spreading device 28, which is likewise a spreading roller, the fine metering belt 25 is provided with a stationary support 27. The stationary support may, like the stationary support 23, be in the form of a transverse shaft supported at its ends.

The thus supported fine metering belt 25 is, in the region of the idler roller 25', likewise provided with a means for measuring the bulk weight falling onto the fine metering belt 25, in the form of a load cell 19.

Prior to the actual spreading of the pre-form, cake or mat onto the final forming belt 50, the finely distributed bulk material coming from the premetering belt 21 is measured by weight once again by the arrangement of the find metering belt 25, the support 27 and the weight-measuring device in the form of a load cell 19, and is volumetrically fine-metered by means of the skimming roller 26. Consequently, the quantity of bulk material escaping per unit time from the metering slit between fine metering belt 25 and skimming roller 26 is metered in terms of volume and weight and then comes into the area of the spreading device which is likewise in the form of a simple spreading roller 28. The particles ejected by this spreading roller 28 then come directly onto the actual forming belt 50 where they become a preform.

The monitoring of the bulk material discharged per unit of time onto the fine metering belt 25 takes place, therefore, via the load cell 18 which measures the weight and which supplies its pulses to the driving mechanism for the drive roller 21'' of the premetering belt 21, controlling the speed of the latter. Through appropriate control of the speed of the premetering belt 21 the quantity of the bulk material conveyed on this premetering belt 21 is also controlled, as a result of which the formation of a build-up of bulk material in front of the skimming roller 22 is prevented. In this way, the flow of bulk material to the spreading roller 28 at the end of the fine metering belt 25 is precisely defined in terms of weight and is always uniform. The load cell 18, therefore, has the task of regulating the quantity of bulk material by changing the speed of the premetering belt 21 so that there is no major build-up in front of the skimming roller 26, but that there is sufficient bulk material on the fine metering belt 25 whereby this quantity of bulk material can always be kept constant.

The speeds of all drive rollers, i.e. of the rollers 16, 21'' and 25'', are adjustable. Likewise, the speed and position of the discharge roller 12 and of the skimming rollers 22 and 26 in relation to the respective belts 21 and 25 are adjustable, in such a way that a constant setting is guaranteed. This also allows simple adaptation to all types of wood and to all mix ratios with the result that the method and the device are suitable also for different bulk materials and binding agents. This is of particular advantage, for example, in the case of very light wood, such as balsawood, whose particle volume is up to five times the size of that of normal wood.

The metering apparatus 20 described above obviates the initially depicted disadvantages of other methods in that it permits optimum distribution of the bulk material by means of a first volumetric metering in the bin by the discharge roller 12, by a second volumetric metering on the premetering belt by the skimming roller 22 and by a third volumetrically metering on the fine metering belt by the skimming roller 26 and by twice checking of the area weights by the weight-measuring means which have the form of load cells 18, 19. Due to the fact that there is virtually no build-up of bulk material in the area of the volumetric metering, namely in the area of the skimming rollers 22 and 26, the density of the bulk material on the fine metering belt 25 is extremely uniform both transverse as well as longitudinal to the conveying direction of the belt. This results in a previously unattained spreading accuracy, which comes particularly to the fore in the case of cement-bound wood particle boards with regard to their strength values. The thus obtained uniform density also guarantees a uniform thickness and considerably smaller fluctuations in the strengths of the series-manufactured boards.

Furthermore, the two-part or twice measuring of the mass (weight) of the bulk material results in a smoothing of the surface of the bulk material and avoids surface undulations which are control-related.

In accordance with a preferred feature of the present invention, the discharge roller 12, and skimming rollers 22 and 26 and the spreading rollers 24 and 28 are each formed as an assembly of axially spaced toothed discs with a tungsten carbide or similar hard tip on each tooth. Several baffle plates 29 are arranged to extend between the discs of the roller 28 for the reason hereinafter described.

Similar metering apparatus 20*a* (not illustrated in detail) is used to deliver material from a further hopper (not shown) to a second spreading head 30*a*.

The spreading head 30 is enclosed within a hood 31 which is spaced above the travelling belt 50 and defines at one end, above the belt, a main air inlet 32 and at the other end a main air outlet 33 which is connected to a suitable air extractor (not shown). A flexible flap 34 seals against the carrier plates on the belt 50 at the point where they enter the spreading station 30. The principal air-flow through the spreading station 30. is controlled by the action of a valve in the outlet duct 33. The flow is, as indicated by arrows B, immediately above the belt 50 and in a direction contrary to the advancement of the carrier plates as indicated by arrow C.

As can be seen, the spreading roller 28 and the discharge end of the second metering belt 25 are arranged in a lateral opening in the hood 31 so that the material from the belt 25 is projected into the interior of the hood substantially horizontally, initially in the same direction as that of the travel of belt 50. This spreading roller 28 rotates at such a speed that the incoming bulk material is broken up and is cast forward in a particle stream. The teeth of the spreading roller 28, as previously described, preferentially project the larger, filamentary particles rather than the finer wood-flour particles, with the result that the former follow a course as generally indicated by arrows D with a large initial horizontal component of velocity whereas the finer particles initially drop much more sharply as indicated at E.

Accordingly, a first-stage separation of coarse and fine particles in achieved. This may be assisted by auxiliary air-flows as indicated by arrows F and G. A gap 35 above the spreading roller 28 allows a controlled inflow of air [F] which helps to carry the coarser particles further horizontally before they meet the main air-flow [B] as hereinafter described. The baffle plates 29 serve to direct the air-flow [F] and minimise any tendency for the roller 28 to induce a lateral component into the air-flow.

A circulating air-flow [G] is induced by a roller assembly 36 which is disposed just beneath the discharge end of conveyor 25 within a generally semi-circular housing portion 37 of the hood 31, which extends upwardly into close proximity with the belt 25 to minimise air inflow at that point.

The roller assembly 36 comprises plurality of axially-spaced toothed discs. Rotation of the roller assembly 36 in the direction of arrow H induces a circulating air-flow [G] which draws the finer particles downwardly towards the belt 50. The circulating air flow [G] ensures that, immediately after being ejected by the spreading roller 28, fine and super-fine particles are separated out of the actual particle stream and are brought downwardly directly towards the carrier belt 50. This guarantees that the fine and superfine particles get into the lowermost layer of the finished board, thereby improving the surface quality of the board.

The roller assembly 36 whose diameter is at least as large as the outside diameter of the spreading roller 28, and which lies directly below the spreading roller 28, co-operates below the drive roller 25' and metering belt 25 with the housing portion 37 which is directed downwardly to the carrier belt 50 and is arched to the rear, such that, firstly, the hood 30 is substantially closed off to the rear from the outside air. In particular there is no substantial air inlet gap between the metering belt 25 and the roller assembly 36.

The position of the roller assembly 36 directly below the spreading roller 28 and the design of this roller assembly 36 such that its diameter is greater than that of the spreading roller 28, has the advantage any very coarse particles falling down more or less vertically from the spreading roller 28 will not drop directly onto the carrier belt 50 and thus enter the outer fine covering layers. Any such particles falling down in this area are intercepted by the assembly 36 and, as a result of its rotation, are ejected by it and redelivered in the direction of the main particle stream so that they get into the middle region of the layer formed on the carrier belt 50.

We have found it advantageous to mount within the curved housing 37 several spaced vertical baffle plates 39 which extend between the individual discs of the roller assembly 36 in order to prevent axial drift of the fine particles. In the absence of such baffle plates there is a tendency for the circulating air-flow [G] to induce an axial component of movement which, if unchecked, would lead to the deposition of more material at one edge of the belt 50 than at the other.

On encountering the main air-flow [B] the falling particles which have undergone a first stage of separation in the direction of movement of the belt 50 are swept rearwardly against the direction of movement of the belt 50, the finer particles being carried furthest. Thus, the fine particles are swept rearwardly into a duct 38 which forms a rearward extension of the hood 31 and are deposited on the carrier plates 50 near their point of entry as defined by flap 34.

Generally, the finest particles follow a longer course than the coarser particles which are deflected least by the main air-flow [B]. The result is that the particles are reliably graded by size so that the finest settle on the carrier plates adjacent to their point of entry, with coarser particles settling in successive layers as the carrier plates progress through the spreading station.

In a typical practical installation, the main air-flow [B] through the spreading station 30 may be controlled by a valve in the exit duct 33 typically to a rate of 2.5 m/sec. The gap 35 above the spreading roller 28 may be approximately 10 mm high, whilst the diameter of the roller 28 may be 280 mm, with a rotational speed typically of 950 rpm. The roller assembly 36 may have a diameter of 400 mm, with a radial gap between the roller and the housing 37 of 15 mm. Typically, the depth of material supplied by the belt 25 may be 50 mm, with a gap between the belt and the roller 28 of only 2 mm.

As will be appreciated, spreading station 30 produces on the carrier plates on belt 50 a layer of material which is graded so that the finest material is lowermost an the coarsest material uppermost.

The second spreading station 30*a* is of similar construction and will not be described specifically, similar parts being indicated by similar reference numerals with the addition of the suffix a. However, in this case the particles are projected in a direction opposite to that in which the belt 50 travels with the result that the coarsest particles are deposited first, on top of the coarse particles from the first spreading station, and the finest particles are swept forwardly into the duct 38*a* so as to be deposited towards the outlet end of spreading station 30*a*, which is defined a vertically adjustable closure plate 34*a*.

Under typical operational conditions, the main air-flow Ba within the hood 31*a* is higher than that within the hood 31, for example 3.0 m/sec.

As will be apparent the finer material, is preferentially directed to the upper and lower portions of the deposited layer, whilst the coarser material is preferentially directed to the middle portion of the layer. Due to the controlled flow conditions in the spreading hoods 30, 30*a*, as well as the preseparation of fine and superfine particles, there results a wedge of spread material with optimum stratification of the finest particles in the outer layers and the coarse particles in the middle layers with previously unattained uniformity and accuracy of the control itself. With the method and device according to the invention it is possible to obtain the excellent spreading of cement-wetted particles without difficulty, even if the bulk material has a high moisture content. The position and size of the roller assembly 36 prevents the undesired falling down of the coarse particles from the spreading roller 28 onto the carrier belt 50 below, whereby this roller assembly 36 also supports the breaking up of the bulk material by the spreading roller 28 so that, in total, it is possible to obtain preforms for cement-bound particle boards which are of high quality in terms of appearance, strength and stability.

Variation of the main air-flow rate and the rotational speed of the spreading roller 28 and the roller assembly 36, make it possible to adjust the various parameters of the deposited layer, so that the same machine can be used to produce boards with a range of properties. In particular increasing the range of rotation of the rollers 36, 36*a* tends to increase the efficiency of separation of the finer particles, with a corresponding decrease in the proportion of coarser particles present at the surfaces of the finished board. Increasing the airflow rate also achieves improved separation of the finer and coarser particles. By varying the air flow rate in the two spreading heads independently it is possible to produce boards with a different surface finish on opposite faces if required.

A further feature of this invention resides in the fact that by increasing or decreasing the main air-flow we have found that it is possible to contour the deposited layer of material so that it is concave, flat or convex in cross-section. In practice varying the main air-flow rate by 0.1 m/sec results in a 1 mm variation in the thickness of the deposited layer on the longitudinal centre-line. Increasing the air-flow decreases the centre-line thickness so as to give a more concave cross-sectional profile, whilst decreasing the air-flow produces a more convex profile. After the formed boards have been pressed and cured to a flat shape the resulting controlled variation of board density across its width enables the physical properties of the board to be tailored to specific requirements.

If it is required to include a web of reinforcing material such as woven or non-woven fabric or a wire mesh, or a web of for example electromagnetic screening material, within the board, it would of course be possible to introduce such web between the two spreading stations onto the layer deposited by the first spreading station.

Although the invention has been illustrated by reference to the manufacture of board comprising cement bonded wood particles, it will be appreciated that it may equally be applied to other analogous materials in which particles of other materials and/or other bonding agents are employed.

The features disclosed in the foregoing description, or the accompanying drawings, expressed in their specific forms or in the terms or means for performing the desired function, or a method or process for attaining the disclosed result, may, separately or in any combination of such features, be utilised for realising the invention in diverse forms thereof.

I claim:

1. A method of spreading a particulate material comprising cement-wetted particles of wood having a range of dimensions to form a layer in which the particles are graded according to their dimensions, comprising the step of initially projecting the particulate material in a first generally horizontal direction and allowing the material to fall gravitationally onto the moving carrier whilst subjecting the material to a controlled air-flow, wherein said step of initially projecting and allowing comprises allowing substantially all of the particles to fall onto the carrier without interacting with any fixed surface and subjecting the falling particles to a through-flow of air immediately above the carrier in a second direction opposite to that in which the particles are initially projected.

2. A method according to claim 1 comprising the further step of subjecting the falling particles at a position beneath the point at which the material is projected to a circulating air-flow to assist downward movement of the falling particles so subjected.

3. A method according to claim 1 wherein said carrier is moved in the same direction as that in which the material is projected and the finer particles are deposited on the carrier before the coarser particles.

4. A method according to claim 1 wherein said carrier is moved in the opposite direction to that in which the material is projected and the finer particles are deposited on the carrier after the coarser particles.

5. A method according to claim 1 wherein the material is projected in opposite directions at two spaced spreading stations beneath which the carrier moves, and the carrier is moved in the same direction as that in which the particles are projected at the spreading station beneath which it moves first, so that the finer particles are concentrated at the upper and lower portions of the deposited layer and the coarser particles are concentrated in the middle portion of the deposited layer.

6. A method according to claim 1 wherein the cement-wetted particles of wood have dimensions in the range 0.5 mm or less to 30 mm or more.

7. A method according to claim 1 wherein the velocity of the air-flow immediately above the carrier is so controlled as to produce a layer of deposited material which is of uniform thickness in a direction transverse to the direction of movement of the carrier.

8. A method according to claim 1 wherein the velocity of the air-flow immediately above the carrier is so controlled as to produce a layer of deposited material of concave shape in section in the direction transverse to the direction of the movement of the carrier.

9. A method according to claim 1 wherein the velocity of the air-flow immediately above the carrier is so controlled as to produce a layer of deposited material of convex shape in section in the direction transverse to the direction of the movement of the carrier.

10. A method according to claim 1 in which the particulate material is delivered at a metered rate to the point at which it is projected, said material being carried by a feed belt at the base of a bin in which said material is stored to a discharge roller whereby the material is discharged from the bin to means for weighing and volumetrically metering said material and feeding it to the point at which it is projected, wherein the depth of material fed to said discharge roller is controlled by a vertically arranged vibrating plate spaced above said feed belt so as to hold back the bulk of the material in the bin and allow a layer of controlled depth to be carried by the feed belt towards the discharge roller.

11. A method according to claim 10 wherein the material is discharged from the bin onto a pre-metering belt, being weighed and volumetrically metered on said pre-metering belt and then spread onto a downstream fine metering belt on which it is again weighed and volumetrically metered.

12. A method according to claim 1 comprising the further steps of compressing and curing said layer to form a board.

13. Apparatus for spreading a particulate material comprising cement-wetted particles of wood having a range of dimensions to form a layer in which the particles are graded according to their dimensions, said apparatus comprising:

(a) means for moving a carrier in a generally horizontal direction, (b) a hood arranged over the path of the carrier and defining a main air inlet and a main air outlet at spaced positions immediately above the path of the carrier, (c) means for projecting said material into said hood in a first generally horizontal direction at a position spaced above the path of the carrier, the hood being so shaped and dimensioned as to allow substantially all of the particles to fall gravitationally onto the carrier without interacting with any fixed surface, and (d) means for causing air to flow through the hood from said main air inlet and immediately above the path of the carrier to said main air outlet so as to establish a main air-flow through the hood in a second direction opposite to that at which the material is initially projected.

14. Apparatus according to claim 13 further comprising a material inlet formed in the hood at a position above and between the main air inlet and main air outlet, and a delivery belt for said particulate material which terminates at said material inlet.

15. Apparatus according to claim 14 wherein said means for projecting said material comprises an input roller which affords a plurality of radially extending elements which engage the material on the delivery belt, the input roller rotating in such a direction and at such a speed as to project the material into the interior of the hood in said first direction.

16. Apparatus according to claim 15 wherein said roller comprises a plurality of axially spaced toothed discs.

17. Apparatus according to claim 16 wherein at the tip of each tooth of each toothed disc an insert of a hard material is provided.

18. Apparatus according to claim 14 wherein a toothed roller is disposed within the hood immediately below the material inlet, the roller being rotated to produce a circulating air-flow within the hood, and the direction of rotation being such the circulating air-flow includes a region of downward air-flow beneath said material inlet.

19. Apparatus according to claim 18 wherein said toothed roller comprises a plurality of axially spaced toothed discs.

20. Apparatus according to claim 19 wherein baffle plates are provided between individual discs at spaced positions along the axis of the toothed roller to reduce axial flow in the circulating air-flow induced by the roller.

21. Apparatus according to claim 13 further comprising means for delivering the particulate material at a metered rate to said means for projecting said material into the hood, said delivery means comprising a bin for a bulk of said material with a feed belt at the base thereof and a discharge roller above said belt, and means for receiving said material from said discharge roller, weighing and volumetrically metering said material, and feeding the material to said means for projecting it into said hood, wherein a vertically arranged vibrating plate is provided above the feed belt at the base of the bin to allow a layer of material of controlled depth to be supplied by the feed belt to the discharge roller.

22. Apparatus according to claim 21 wherein said metering means comprises a pre-metering belt arranged to receive material from said discharge roller and weigh and volumetrically meter said material and a downstream fine metering belt arranged to receive said material from said pre-metering belt and again weigh and volumetrically meter said material.

23. Apparatus according to claim 17 wherein said insert of a hard material is made of tungsten carbide.

* * * * *